US007556000B2

(12) United States Patent
Pierik et al.

(10) Patent No.: US 7,556,000 B2
(45) Date of Patent: Jul. 7, 2009

(54) CAMSHAFT PHASER HAVING DESIGNATED CONTACT VANE

(75) Inventors: Ronald J. Pierik, Rochester, NY (US); Dominic Borraccia, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 1030 days.

(21) Appl. No.: 10/421,424

(22) Filed: Apr. 23, 2003

(65) Prior Publication Data

US 2003/0217720 A1 Nov. 27, 2003

Related U.S. Application Data

(60) Provisional application No. 60/382,237, filed on May 21, 2002.

(51) Int. Cl.
*F01L 1/34* (2006.01)

(52) U.S. Cl. ..... 123/90.17; 123/90.15; 29/889.23; 464/160

(58) Field of Classification Search ..... 123/90.15, 123/90.16, 90.17, 90.18, 90.27, 90.31; 464/1, 464/2, 160; 74/568 R; 29/402.05, 402.06, 29/888.02, 888.1, 889, 889.23, 596, 6.01, 29/888.025, 56.5, DIG. 26; 92/120–126
See application file for complete search history.

(56) References Cited

U.S. PATENT DOCUMENTS 4,864,917 A * 9/1989 Methot ..... 92/55
5,865,151 A * 2/1999 Fukaya et al. ..... 123/90.17
5,875,750 A * 3/1999 Iwasaki et al. ..... 123/90.17
5,947,067 A * 9/1999 Kawaharaguchi et al. ..... 123/90.17
6,012,419 A * 1/2000 Iwasaki et al. ..... 123/90.17
6,024,061 A * 2/2000 Adachi et al. ..... 123/90.17
6,176,210 B1 1/2001 Lichti et al.
6,199,524 B1 * 3/2001 Ushida ..... 123/90.17
6,276,321 B1 8/2001 Lichti et al.
6,330,870 B1 * 12/2001 Inoue et al. ..... 123/90.17
6,412,462 B1 7/2002 Lichti et al.
6,443,112 B1 * 9/2002 Kinugawa ..... 123/90.17
6,460,496 B2 * 10/2002 Fukuhara et al. ..... 123/90.17
6,474,280 B2 * 11/2002 Maeyama et al. ..... 123/90.17
6,484,678 B2 * 11/2002 Kinugawa ..... 123/90.17
6,505,586 B1 * 1/2003 Sato et al. ..... 123/90.17
6,532,921 B2 * 3/2003 Sato et al. ..... 123/90.17
6,637,390 B1 10/2003 Dauer et al.

* cited by examiner

*Primary Examiner*—Ching Chang
(74) *Attorney, Agent, or Firm*—Thomas W. Twomey

(57) ABSTRACT

In a vane-type camshaft phaser, one vane extends over a much larger internal angle than the other two vanes. Because of its size and strength, the large vane is the vane designated for contact with the stator. The other vanes and lobes have extra clearance to prevent contact regardless of rotor position. In one embodiment, a first surface of the large vane engages a surface of a first adjacent lobe at one extreme rotor rotation, and a second surface of the large vane engages a surface of a second adjacent lobe at the opposite extreme of rotation. The contact surfaces of the lobes and the vane may be equipped with hardened wear pads. One or more wear pads may be machined to provide a desired rotor displacement angle.

2 Claims, 8 Drawing Sheets

CAMSHAFT PHASER HAVING DESIGNATED CONTACT VANE

RELATIONSHIP TO OTHER APPLICATIONS AND PATENTS

This application claims priority from Provisional U.S. patent application, Ser. No. 60/382,237, filed May 21, 2002.

TECHNICAL FIELD

The present invention relates to a camshaft phaser for controlling the phase relationship between the crankshaft and a camshaft of an internal combustion engine; more particularly, to a vane-type phaser having a plurality of interspersed stator lobes and rotor vanes; and most particularly, to a vane-type phaser wherein one of said vanes extends over a larger central angle than any of the other vanes and wherein only the larger vane makes contact with a stator lobe to control the rotor's position and displacement angle.

BACKGROUND OF THE INVENTION

Camshaft phasers for varying the phase relationship between the pistons and the valves of an internal combustion engine are well known and need not be described in greater detail here. In a vane-type phaser, a rotor having a plurality of spaced-apart vanes is rotatably disposed within a stator having a plurality of spaced-apart lobes. Advance and retard oil chambers are thus formed between the vanes and the lobes.

A problem exists in prior art vane-type camshaft phasers wherein the lobes and vanes typically are arranged generally symmetrically about the phaser axis. The rotor vanes may be bent or otherwise damaged by high-impact contact with the lobes during an uncontrolled event such as at engine start-up. Further, since the included angle of the rotor vanes and the stator lobes, as cast, determine the starting point and the total angular displacement of the cam phaser in the prior art, the starting point of the rotor and angular displacement of the phaser can not be precisely controlled because of casting tolerances.

Therefore, what is needed is a means for preventing phaser damage from rotor/stator contact.

Also what is needed is a means for accurately controlling the starting position and displacement angle of the rotor.

It is a principal object of the present invention to provide an improved camshaft phaser wherein damage to vanes and lobes is prevented during high-impact events and a means for adjusting the starting position and angular displacement of the rotor is provided.

SUMMARY OF THE INVENTION

Briefly described, a vane-type camshaft phaser in accordance with the invention comprises a plurality of interspersed stator lobes and rotor vanes, preferably three stator lobes and three rotor vanes. The lobes and vanes are disposed in rotationally asymmetric pattern about an axis. In one embodiment, one vane extends over a much larger internal angle than the other two vanes such that it is a larger and stronger vane and is more capable of sustaining intense mechanical shock. A first surface of the large vane engages a surface of a first adjacent lobe at one extreme rotor rotation, and preferably a second surface of the large vane engages a surface of a second adjacent lobe at the opposite extreme of rotation. Either or both surfaces of the lobes and the large vane may be equipped with hardened wear pads as contact surfaces. By machining one or more of the contact surfaces in a secondary operation, the starting position of the rotor and displacement angle of the phaser can be accurately calibrated.

In a second embodiment, the first two of three vanes extend over a larger internal angle than the third vane. The first two vanes straddle an associated stator lobe and engage adjacent surfaces of the lobe. The contacting surfaces of the lobe and vanes may be equipped with hardened wear pads. By machining one or more of the contact surfaces in a secondary operation, the starting position of the rotor and displacement angle of the phaser can be accurately calibrated.

Because of its size and strength, the large vane is the vane designated for contact with the stator. The non- contacted vanes and lobes have extra clearance to prevent contact regardless of rotor position. The designated vane, being stronger than the other two narrower vanes, is better able to sustain the shock of impact when a vane strikes a lobe in an uncontrolled event such as at engine start-up. The rotor displacement angle may be limited and calibrated by secondary machining operations on the stator lobe and/or the large vane contact surfaces.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
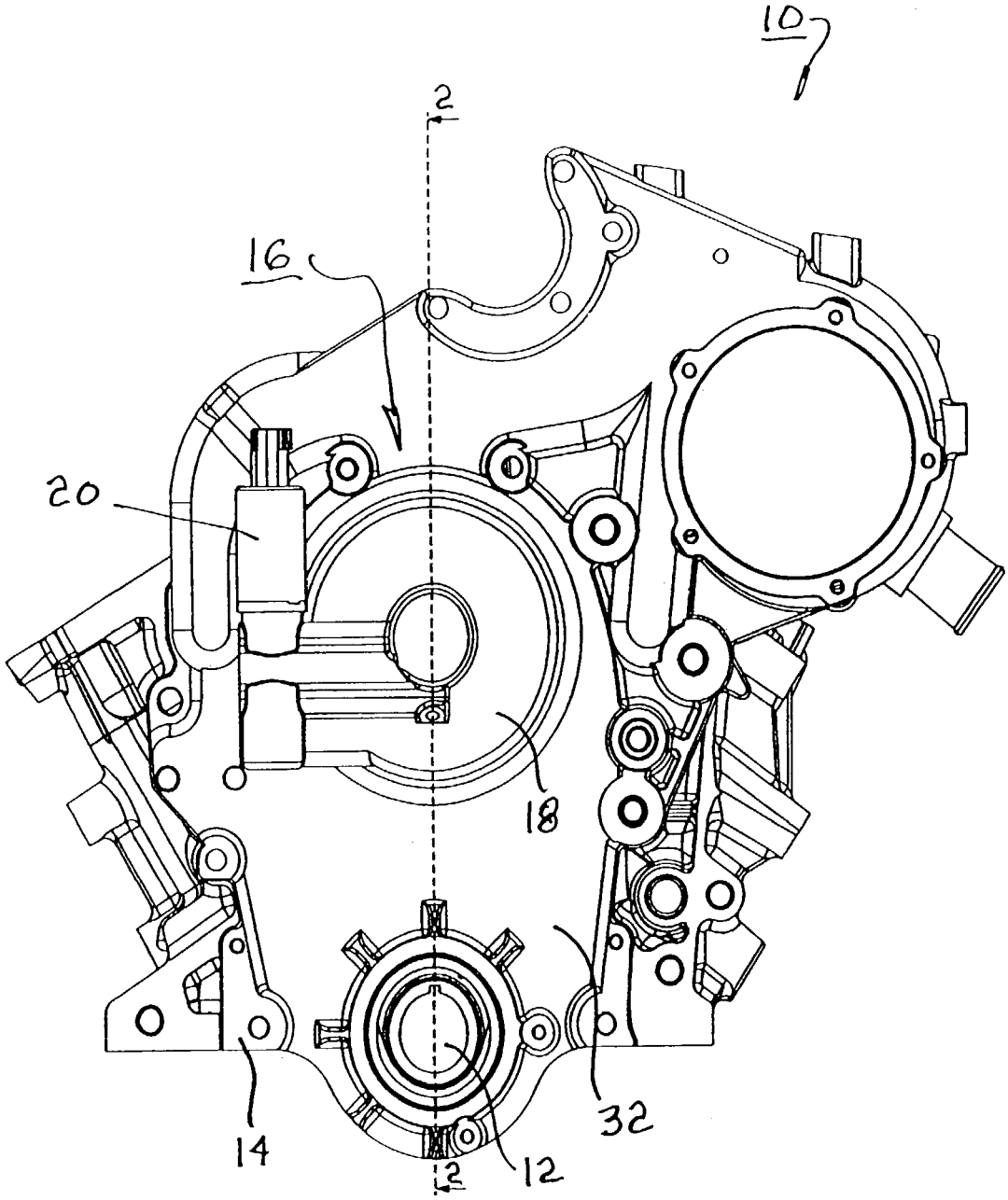
FIG. 1 is a front elevational view of a partially assembled internal combustion engine, showing location of a camshaft phaser in accordance with the invention.

Referring to FIGS. 1 through 5, a partially-assembled internal combustion engine, shown generally as item 10, includes a crankshaft 12 disposed conventionally on block 14. A vane-type camshaft phaser 16 disposed on the front of engine 10 includes an outer cover 18 supporting and cooperating with an oil control valve 20 for controlling oil flow into and out of the phaser. Valve 20 receives pressurized oil from an oil gallery 22 in the engine block, as described below, and selectively distributes oil to timing advance and retard chambers within phaser 16, also as described below, to controllably vary the phase relationship between the engine's camshaft 24 and crankshaft 12 as is known in the prior art.

Camshaft 24 is supported in a camshaft bearing 26 and is hollow at the outer end and threaded conventionally for receiving a phaser attachment bolt 28. Bearing 26 is modified from standard to extend forward of the end of camshaft 24 for rotatably supporting on an outer surface 27 thereof a drive means 30 such as, for example, a camshaft pulley or sprocket connected in known fashion via a timing belt or chain (not shown) to a smaller pulley or sprocket (not shown) mounted on the outer end of crankshaft 12. The two sprockets and timing chain are enclosed by a timing chain cover 32 mounted to engine block 14.

Phaser 16 includes a stator 34 fixedly mounted to sprocket 30 for rotation therewith and an inner cover plate 36 conventionally attached to stator 34 and sprocket 30 via shouldered bolts 31 to define a rotor chamber 35. Stator 34 is formed having a plurality of spaced-apart inwardly-extending lobes 38. Between sprocket 30 and plate 36 is disposed a rotor 40 having a hub 41 and a plurality of outwardly-extending vanes 42 interspersed between lobes 38 to form a plurality of opposing advance and retard chambers 44,46 therebetween. This arrangement is well known in the prior art of vane-type camshaft phasers and need not be further elaborated here.

Figure 5:
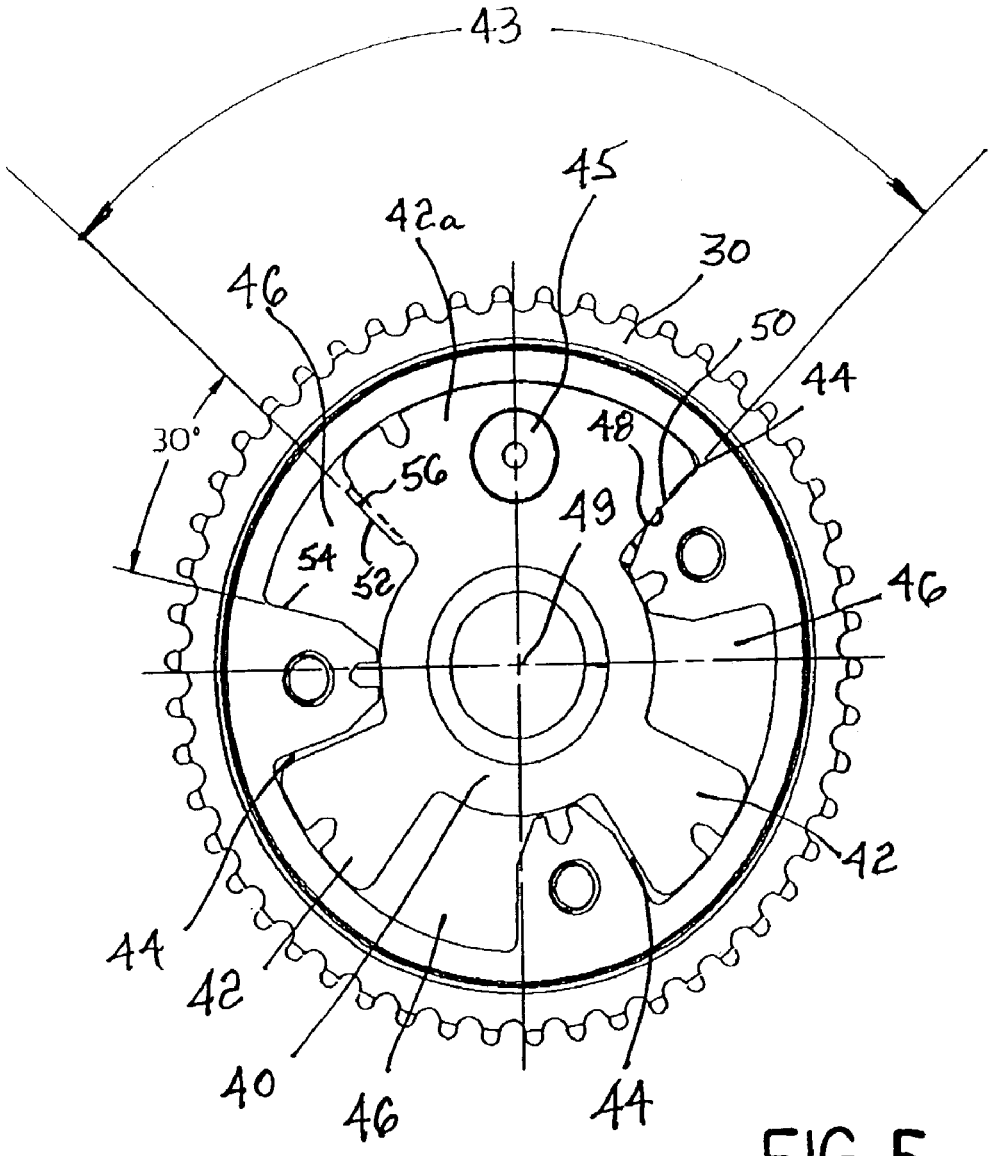
FIG. 5 is a plan view of the camshaft phaser partially assembled, showing the sprocket, stator, and rotor.

The preferred embodiment comprises three stator lobes and three rotor vanes. The lobes and vanes are arranged asymmetrically about axis 49 as shown in FIG. 5, permitting use of a vane 42*a* extending over a much larger internal angle 43 than the other two vanes 42. Vane 42*a* is thus able to accommodate a locking pin mechanism 45 as described more fully below. Further, a first surface 48 of large vane 42*a* engages a lobe surface 50 at one extreme rotor rotation, as shown in FIG. 5, and a second surface 52 of large vane 42*a* engages a lobe surface 54 at the opposite extreme of rotation. Either or both surfaces 48,52 may be equipped with hardened wear pads 56. Alternately, either or both lobe surfaces 50,54 of stator 34 may be equipped with hardened wear pads 56.

Figure 5A:
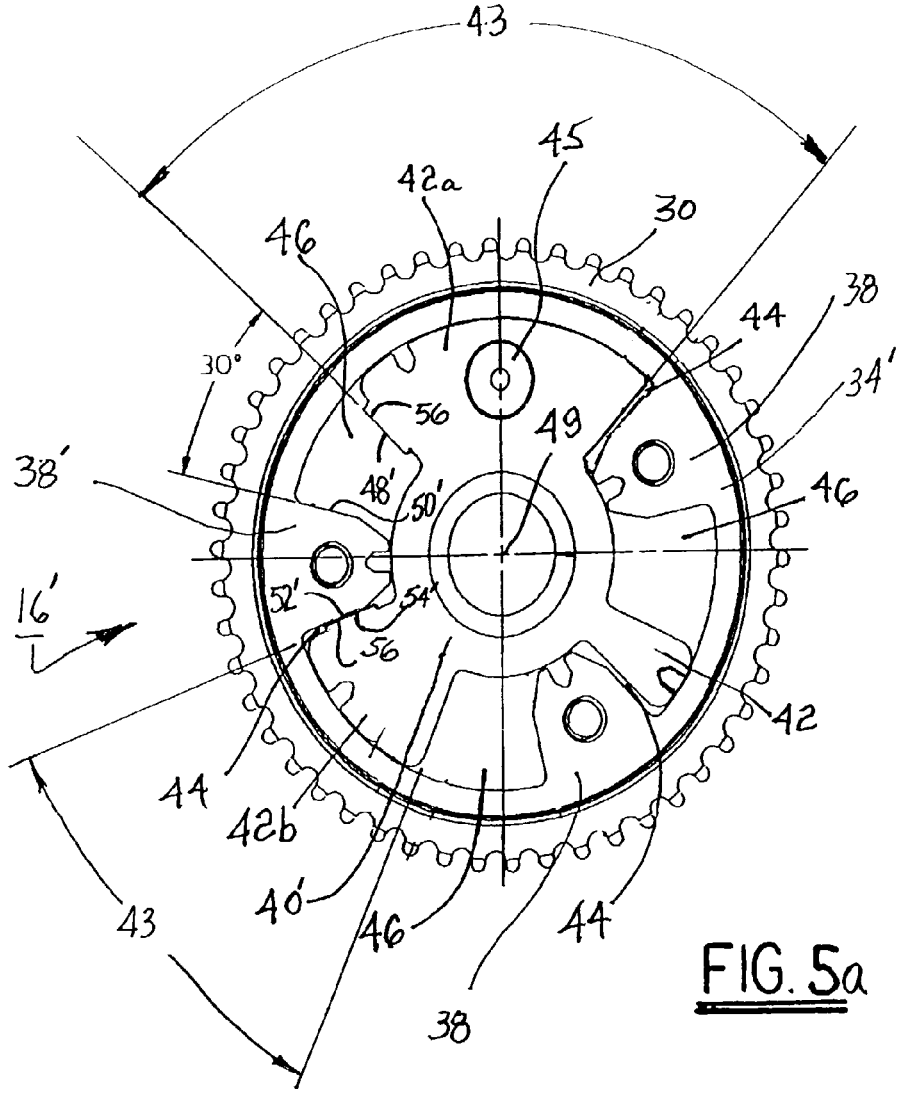
FIG. 5*a* is a plan view of the phaser partially assembled, showing a second embodiment of the rotor vanes.
Figure 6:
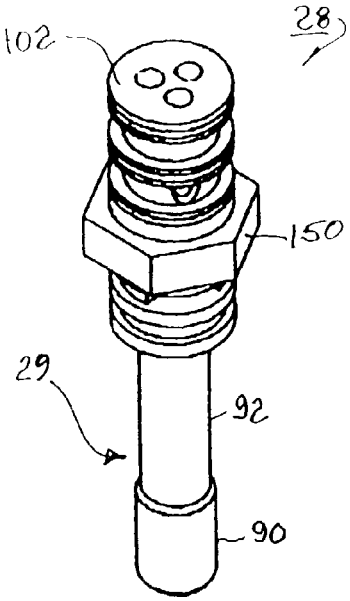
FIG. 6 is an isometric view of a combination attachment bolt and oil conduit element for the camshaft phaser shown in FIG. 3.
Figure 7:
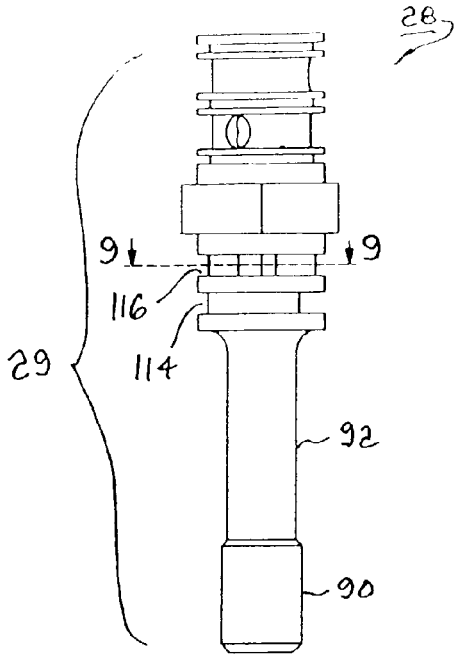
FIG. 7 is an elevational view of the bolt shown in FIGS. 3 and 6.

Only the wide rotor vane 42*a* actually touches the stator lobes at the extremes of rotor rotation; the other vanes and lobes have extra clearance to prevent contact regardless of rotor position. The wide angle vane 42*a* is stronger than the other two narrower vanes 42 and thus is better able to sustain the shock of impact when a vane strikes a lobe in an uncontrolled event such as at engine start-up. The rotor displacement angle, preferably about 30° as shown in FIG. 5, may be limited and calibrated by secondary machining operations on the stator lobe and/or rotor vane wear pads. The machining operation can also be used to set the starting position of the rotor to assure proper alignment of the locking pin mechanism 45 when the rotor is in its default position. In an alternate embodiment (FIG. 5*a*), vanes 42*a* and 42*b* of rotor 40' each have larger internal angles 43 than the third vane 42. Vanes 42*a* and 42*b* straddle an associated stator lobe 38' of stator 34'. Contact surfaces 48' and 52' of vanes 42*a* and 42*b* engage contact surfaces 50' and 54' of lobe 58. Either or both vane contact surfaces 48' and 52' may be equipped with wear pads 56. Alternately, the wear pads can be on either or both surfaces 50' and 54' of stator lobe 38'. By machining one or more of the contact surfaces, the starting position of the rotor and displacement angle of the phaser 16' can be accurately calibrated.

Referring to FIGS. 2 through 5, locking pin mechanism 45 is disposed in a bore 60 in rotor vane 42*a* for controllably engaging a well 62 in sprocket 30 as desired to rotationally lock the rotor and stator together. Mechanism 45 comprises a lock pin sleeve 64 disposed in bore 60 and extending from vane 42*a* through an arcuate slot 66 in inner cover plate 36. Sleeve 64 terminates in an enlarged head 67 for retaining an external bias spring 68, as is described more fully below. Preferably, slot 66 includes a portion 70 wide enough to permit passage of head 67 through the slot during assembly of the phaser. Slot 66 extends through a central arc at least equal to the actuation arc of the rotor within the stator, preferably about 30° as noted above. Vane 42*a* is of sufficient angular width such that the advance and retard chambers adjacent thereto are not exposed to slot 66 even at the extremes of rotor rotation. An outside surface 37 of inner cover plate 36 may be optionally equipped with supporting flanges 69. Flanges 69 serve to provide support to spring 68, during phaser operation, so that the torque applied to the rotor by the spring through its operational range is repeatable and as designed. Also, centering of spring body 68*a* by flanges 69 relative to the center of rotation of the cam phaser helps to balance the phaser during high rotational speeds. In addition, flanges 69 serve to stiffen cover plate 36 to improve sealability of the phaser against oil leakage.

Slidingly disposed within an axial bore 71 in sleeve 64 is a lock pin 72 having a locking head portion 74 for engaging well 62 and a tail portion 76 extending through sleeve head 67. Lock pin 72 is single-acting within bore 71. A compression spring 78 within bore 71 urges pin 72 into lock relationship with well 62 whenever they are rotationally aligned. A groove 80 in sprocket 30 (FIG. 3) connects well 62 with a retard chamber 46 in the assembled phaser such that oil pressure applied to the retard chambers overcomes spring 78 to retract pin 72 into bore 71, unlocking the rotor from the stator.

Figure 4:
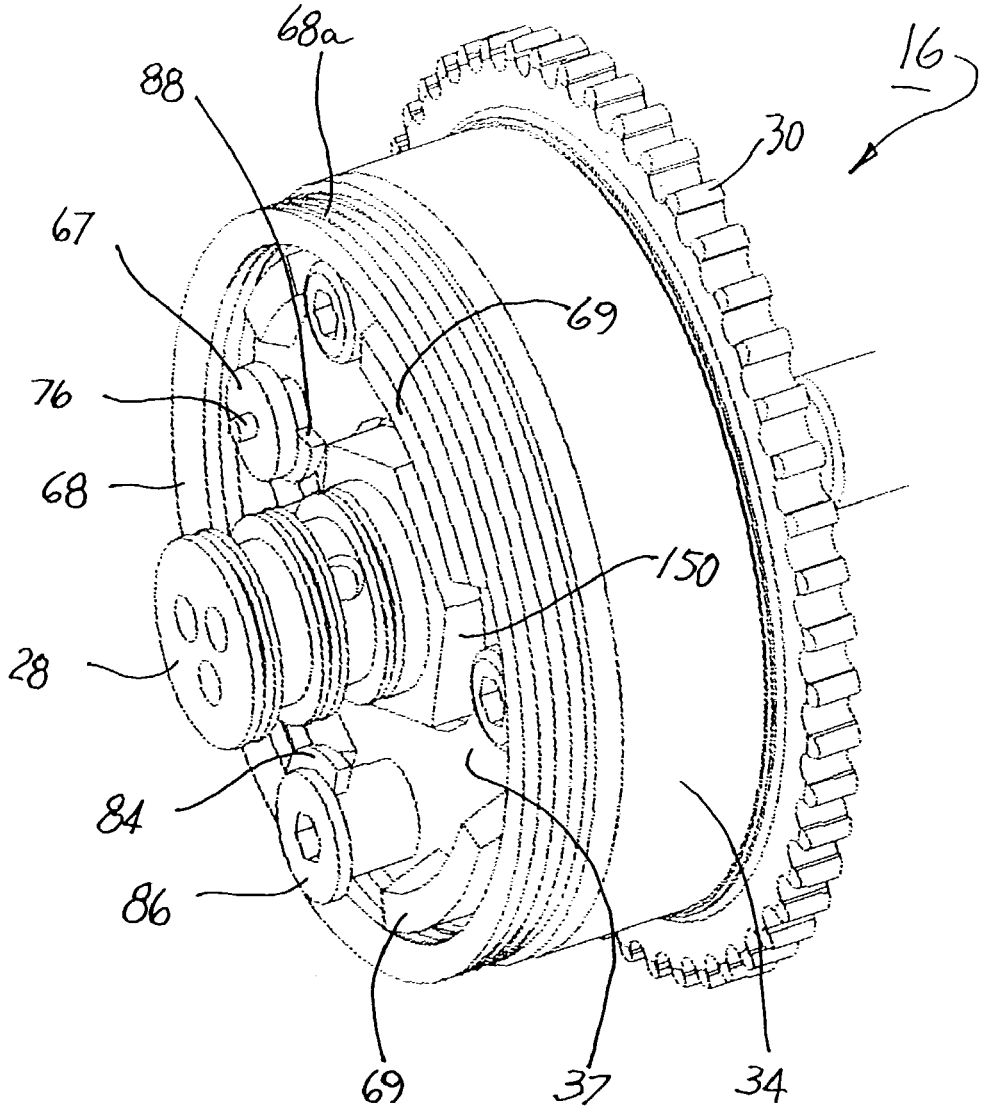
FIG. 4 is an assembled isometric view of the camshaft phaser shown in FIG. 3, the cover and oil control valve being omitted for clarity.

An advantage of the present locking pin mechanism is that tail portion 76 extends beyond cover plate 36 and head 67 (FIG. 4). This feature permits the lock pin to be manually retracted by an operator by grasping tail portion 76 while the phaser is being installed or removed from the engine, thus preventing damage from high torque exerted via cam attachment bolt 28 in bolting the phaser to the engine. Tail portion 76 can also be used to detect whether lock pin 72 is engaged in well 62 while the engine is operating such as, for example, by the use of a Hall Effect sensor.

Figure 2:
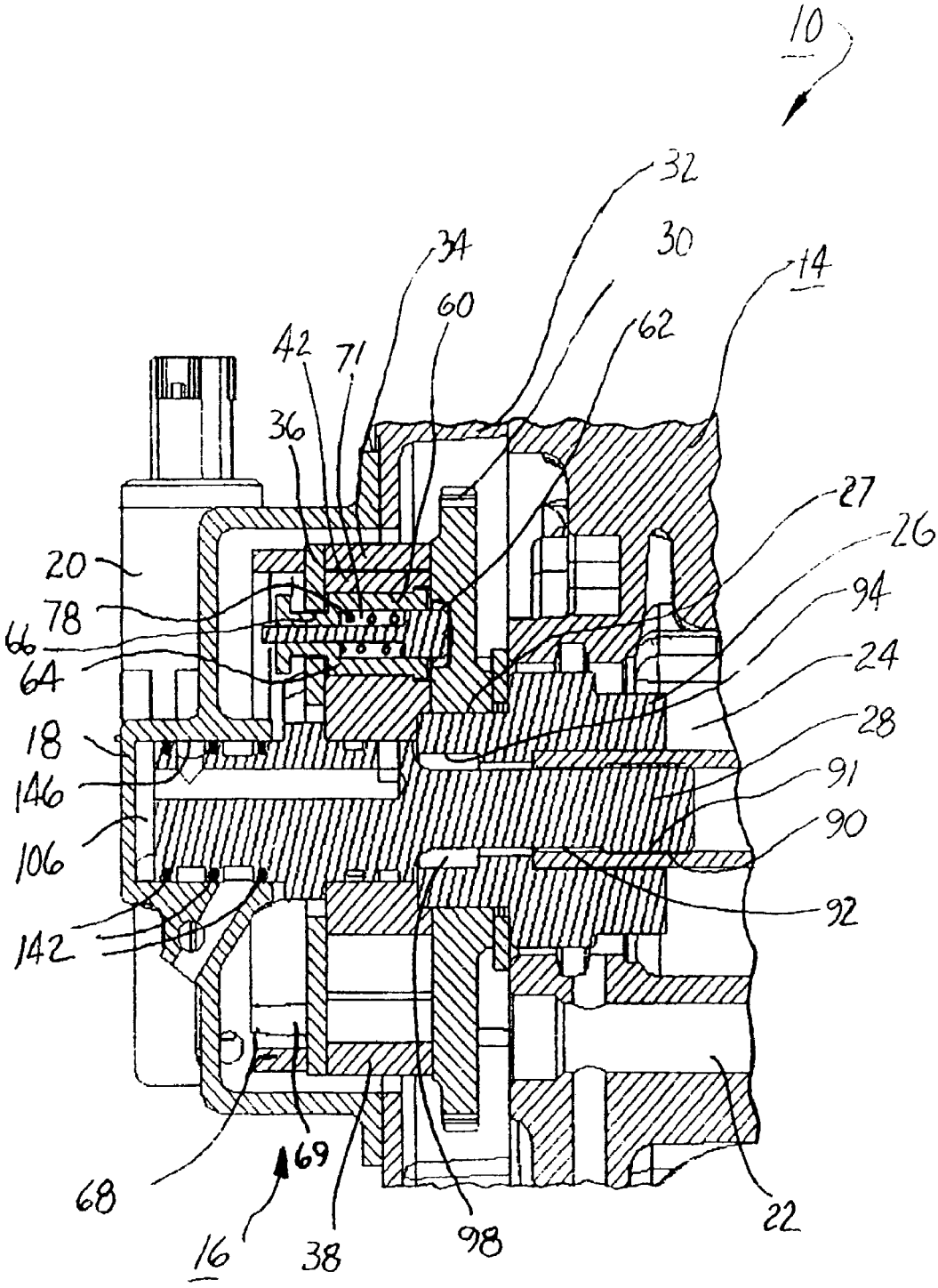
FIG. 2 is a portion of an elevational cross-sectional view through the engine shown in FIG. 1, taken along line 2-2 therein.
Figure 3:
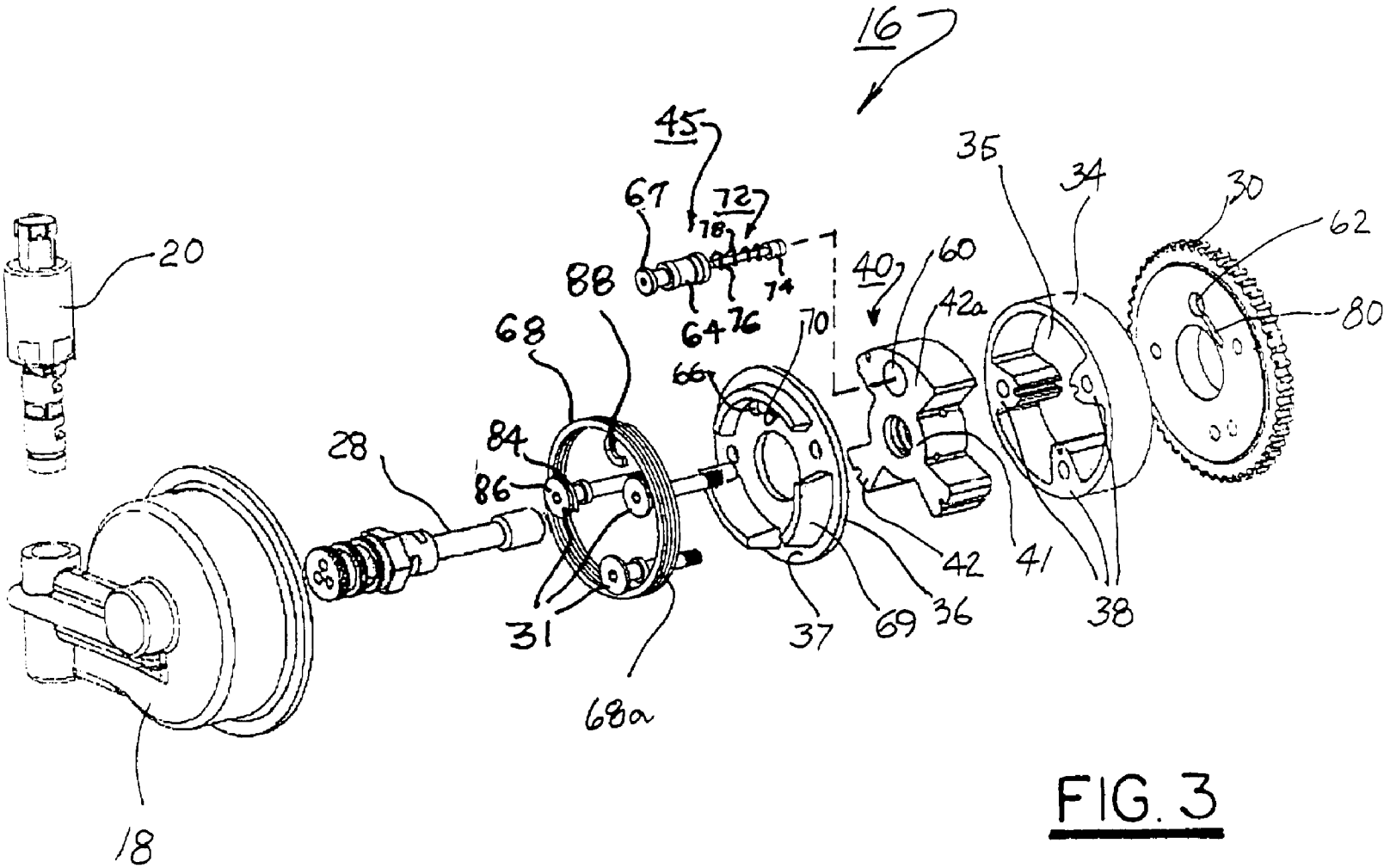
FIG. 3 is an exploded isometric view of a vane-type camshaft phaser in accordance with the invention.

Referring to FIGS. 2 through 4, multiple-turn torsion bias spring 68 is disposed on the outer surface 37 of cover plate 36. A first tang 84 is engaged with a mandrel end 86 of a shouldered bolt 31, and a second tang 88 is engaged with head 67 of locking pin assembly 45. The spring is pre-stressed during phaser assembly such that the locking pin assembly, and hence rotor 40, is biased at its rest state to the fully retarded position shown in FIG. 5. Prior art phasers are known to employ a bias spring within the rotor chamber, but assembly of such an arrangement is difficult and prone to error. The external spring in accordance with the invention is easy to install, and correct installation is easily verified visually.

Referring to FIGS. 2 through 11, phaser attachment bolt 28 serves the added purpose of providing passages for oil to flow from engine gallery 22 via bearing 26 to oil control valve 20 and from control valve 20 to advance and retard chambers 44,46.

Figure 8:
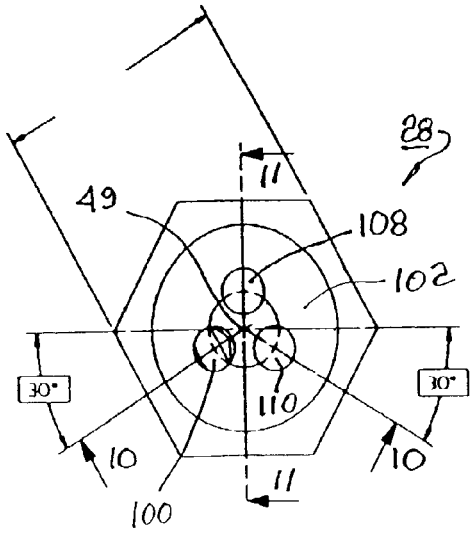
FIG. 8 is a top view of the bolt shown in FIGS. 3 and 6, showing the relationship of various oil passages therein.
Figure 9:
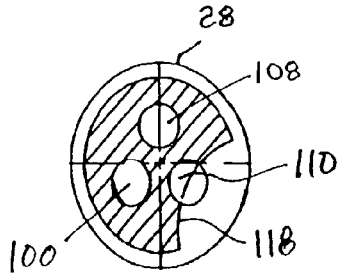
FIG. 9 is a cross-sectional view taken along line 9-9 in FIG. 7, showing access to one of the oil passages.
Figure 10:
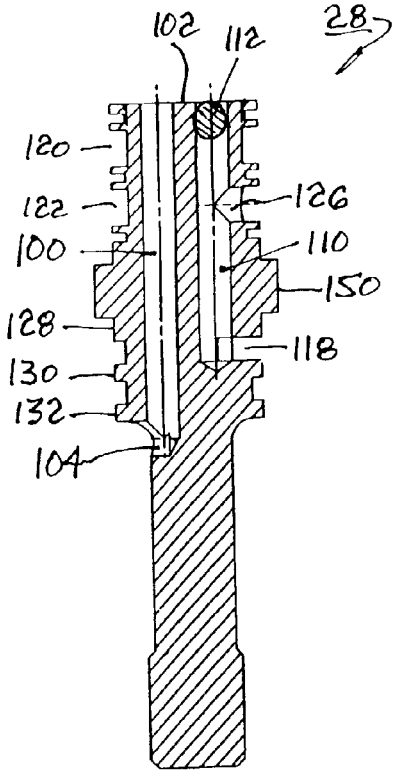
FIG. 10 is a broken cross-sectional view of the bolt taken along line 10-10 in FIG. 8.
Figure 11:
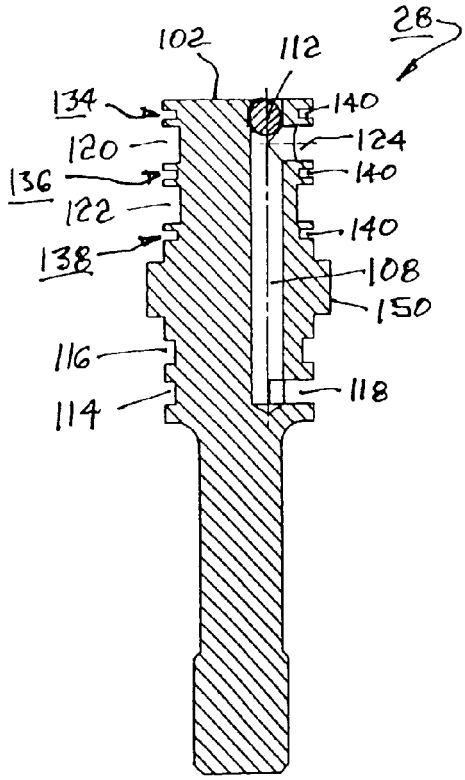
FIG. 11 is a cross-sectional view of the bolt taken along line 11-11 in FIG. 8.

Bolt 28 has a bolt body 29 having a threaded portion 90 for engaging threaded end 91 of camshaft 24 as described above and a necked portion 92 cooperative with bore 94 in bearing 26 to form a first intermediate oil reservoir 98 in communication with gallery 22 via a passage (not shown) through bearing 26. A first longitudinal passage 100 in bolt 28 is formed as by drilling from bolt outer end 102 and extends internally to proximity with necked portion 92. An opening 104 connects passage 100 with reservoir 98. Oil is thus admitted via elements 104,100,102 to a second intermediate reservoir 106 (FIG. 2) formed between outer cover 18 and bolt outer end 102 from whence oil is supplied to control valve 20 via a passage (not shown) formed in outer cover 18. In a currently preferred embodiment, a check valve, such as for example, a ball check or flapper valve, is disposed in the oil supply passage leading to the oil control valve to enhance the overall phaser system stiffness and response rate. Second and third longitudinal passages 108,110 in bolt 28 are formed as by drilling from outer end 102, then are plugged as by a press-fit ball 112 or other means to prevent entrance of oil from reservoir 106. The three passages preferably are angularly disposed symmetrically about bolt and phaser axis 49 as shown in FIG. 8. Passages 108,110 are each drilled to a predetermined depth proximate to respective inner annular oil supply grooves 114,116 formed in the surface of bolt 28 for mating with an advance or retard oil channel (not shown) in the phaser rotor; then, each passage is opened to its respective annular oil supply groove preferably by removal of an arcuate bolt section 118, as shown in FIGS. 9 through 11. Further, outer annular oil supply grooves 120,122 mate with control passages (not shown) in the cam cover 18. Each longitudinal passage 108,110 is opened to its respective outer annular oil supply groove 120,122 by drilling radial connecting bores 124,126, respectively.

Lands 128,130,132 prevent leakage from inner grooves 114,116 by being machined to have a close fit within the rotor bore. Because in operation of the phaser the bolt turns with the rotor, no special seals are required. However, because the bolt rotates within cover 18, special seals are necessary for outer annular oil grooves 120,122. Preferably, outer lands 134,136, 138 each comprise twin lands separated by a narrow annular groove 140, each groove being provided with a metal seal ring 142 which is compressed radially into the cover bore 146 and thus is fixed with the cover and does not turn with the bolt.

Bolt 28 is further provided with means for installing the bolt into the camshaft, preferably a wrenching feature. For example, a hexagonal socket (not shown) may be formed in end surface 102 or preferably an external hexagonal feature 150 is formed into the middle region of bolt 28, which feature may be easily wrenched during phaser assembly by an appropriately deep socket wrench.

Thus, when the phaser is fully assembled and installed onto an engine, oil is provided from oil gallery 22 to control valve 20 via first passage 100 and from valve 20 to advance and retard chambers in the phaser via second and third passages 108,110. No modification is required of the engine block or camshaft in order to fit the present phaser to an engine.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method of adjusting rotor displacement angle of a vane-type camshaft phaser comprising:

a) determining a desired rotor displacement angle;

b) providing a stator having at most three spaced-apart lobes, said lobes including at least one contact surface;

c) providing a rotor having at most three spaced-apart vanes for being rotatably disposed within said stator, said vanes including at least one surface for contacting said at least one contact surface of said lobes;

d) forming two adjacent vanes to make contact with one of said stator lobes disposed between said adjacent vanes during rotational motion of said rotor within said stator; and e) machining at least one of said at least one vane contact surface, and said at least one lobe contact surface so as to provide said desired rotor displacement angle.

2. The method in claim 1 wherein said two adjacent vanes and said lobe disposed between said adjacent vanes make contact along respective surfaces thereof, and wherein both of said contacting surfaces of adjacent vanes comprise a wear pad.

* * * * *